United States Patent [19]

Gupta et al.

[11] 4,198,442

[45] Apr. 15, 1980

[54] METHOD FOR PRODUCING ELEVATED TEMPERATURE CORROSION RESISTANT ARTICLES

[75] Inventors: Dinesh K. Gupta; Louis E. Dardi, both of Muskegon; William R. Freeman, Jr., North Muskegon, all of Mich.

[73] Assignee: Howmet Turbine Components Corporation, Muskegon, Mich.

[21] Appl. No.: 847,253

[22] Filed: Oct. 31, 1977

[51] Int. Cl.[2] ..... B05D 3/06

[52] U.S. Cl. ..... 427/34; 75/171; 427/405; 427/423; 428/667; 428/677; 428/678; 428/679; 427/376.8; 427/383.9

[58] Field of Search ..... 427/376 G, 376 H, 383 D, 427/405, 34, 423; 428/667, 668, 678, 679, 680; 75/134 F, 171

[56] References Cited

U.S. PATENT DOCUMENTS

| | | | |
|---|---|---|---|
| 3,928,026 | 12/1975 | Hecht et al. | 428/678 |
| 4,005,989 | 2/1977 | Preston | 428/678 |

*Primary Examiner*—John H. Newsome

*Attorney, Agent, or Firm*—McDougall, Hersh & Scott

[57] ABSTRACT

A method for the production of metal articles resistant to corrosion at elevated temperatures. The method involves the application of a first coating on an article surface, this coating comprising a cobalt, iron or nickel alloy which is compatible with the substrate and which is ductile in character. A second coating highly resistant to corrosion at elevated temperatures is applied over the first coating to form a composite coating, and an elevated temperature treatment follows to provide interfacial bonding and to minimize the detrimental effects of thermal and mechanical stresses encountered during use. The provision of a ductile first layer provides a barrier against degradation of the corrosion resistance of the outer layer and serves as a barrier against detrimental interdiffusion and crack propagation.

7 Claims, 2 Drawing Figures

METHOD FOR PRODUCING ELEVATED TEMPERATURE CORROSION RESISTANT ARTICLES

BACKGROUND OF THE INVENTION

This invention relates to metal articles which are subjected to elevated temperatures during use. In particular, the invention is concerned with a method for significantly improving the elevated temperature corrosion resistance of such articles whereby more satisfactory performance and longer life for such articles can be obtained.

Elevated temperature exposure of metal articles is experienced in many situations. Metal components are subjected to such conditions, for example, in various aerospace applications and in land and marine operations such as in the case of components utilized in gas turbine engines.

In all such applications, it is important to provide some means for preventing undue corrosion of the components involved since such corrosion can materially shorten the useful life of the components. Deterioration of components can also create significant performance and safety problems.

Various alloys, including most superalloys, are characterized by a degree of corrosion resistance; however, such resistance is significantly decreased when unprotected superalloy components are exposed at the operating temperatures involved in certain systems. For that reason, such components have been provided with coatings, such as aluminide coatings, which increase the corrosion resistance at the extreme operating temperatures.

Aluminide coatings are applied by methods such as the pack cementation process. In this process, the substrate chemistry and the processing temperature exert a major influence on coating chemistry, thickness and properties. Specifically, the coatings comprise a hard, brittle outer layer and a hard, brittle multi-phase sublayer that can crack when subjected to operating conditions. This leads to poor fatigue properties and the cracks can also materially reduce the corrosion resistance of the coated components.

Another class of coatings is the MCrAlY overlay coatings where M stands for a transition metal element such as Fe, Co, or Ni. Presently, these coatings are applied by vacuum vapor deposition of MCrAlY alloy on a superalloy surface. Such MCrAlY coatings have been shown to have an advantage over aluminide coatings in providing extended life to turbine components. Specifically, MCrAlY coatings demonstrate greater corrosion resistance than aluminide coatings and exhibit superior ductility.

In the past, efforts to improve the corrosion resistance of MCrAlY coatings generally have met with only limited success. One approach is to increase corrosion resistance by either raising the amount of aluminum or adding other beneficial constituents to the coating. Unfortunately, this practice can result in embrittled coating compositions which fail prematurely under thermal and mechanical stresses. A second approach is to increase the thickness of the coating without changing the composition. Unfortunately, thicker coatings can be expensive to produce using slow deposition rate processes such as vapor deposition, and distinct thickness limitations exist because very thick coatings tend to crack or spall when subjected to the gas turbine engine environment.

Applicants' copending application Ser. No. 821,546 filed on Aug. 3, 1977, and entitled "Process for Producing Elevated Temperature Corrosion Resistant Articles", describes a process wherein coatings are applied to superalloy substrates and the like to improve the elevated temperature performance of the articles. This process involves the application of an overlay of an MCrAlY composition followed by the application of an aluminide layer. Furthermore, the coated articles are subjected to a hot isostatic pressing operation wherein pressures in excess of about 10,000 psi are applied at temperatures in excess of about 2000° F.

SUMMARY OF THE INVENTION

This invention relates to the production of metal articles resistant to corrosion and otherwise characterized by highly efficient operation at elevated temperatures. A first coating is applied to an article surface, this coating comprising a cobalt, nickel or iron base alloy compatible with the substrate and characterized by high ductility. This coating essentially comprises from 15 to 30 percent by weight chromium, 3 to 7 percent by weight aluminum, up to 5 percent by weight of an element selected from the group consisting of yttrium and the rare earth elements, the balance being selected from the group consisting of nickel, cobalt and iron.

A second coating which is particularly highly resistant to corrosion at elevated temperatures is applied over the first coating. This second coating essentially comprises from 10 to 30 percent by weight chromium, 25 to 35 percent by weight aluminum, up to about 5 percent by weight of one or more elements selected from the group consisting of yttrium, scandium, cerium, hafnium, zirconium, titanium and tantalum, the balance comprising a member selected from the group consisting of iron, nickel and cobalt.

An elevated temperature treatment in the range of 1900° to 2200° F. for a duration of one to 10 hours in an inert atmosphere (for example, in a vacuum or in an argon atmosphere) follows the coating process. The heat treatment achieves interfacial bonding, particularly minimizing any detrimental effects of thermal and mechanical stresses encountered during use. The provision of the ductile first layer or coating serves to provide a barrier against degradation of the corrosion resistance of the second layer or coating and serves as a barrier against detrimental interdiffusion and crack propagation.

Various procedures may be employed for application of the coatings or layers; however, it is preferred that the coatings be applied by means of a plasma spraying operation. This type of operation is particularly advantageous since it permits an uninterrupted operation wherein the first layer is formed in one stage of the process and the second layer of different composition being formed in a second stage of the process. In addition, the plasma spray process offers sufficient deposition flexibility to avoid an abrupt transition from the first layer to the second layer, if desired. Moreover, it permits great flexibility in the choice of compositions to be deposited, and relatively thick coatings can be produced economically, if desired.

DESCRIPTION OF THE PREFERRED EMBODIMENTS

Figure 1:
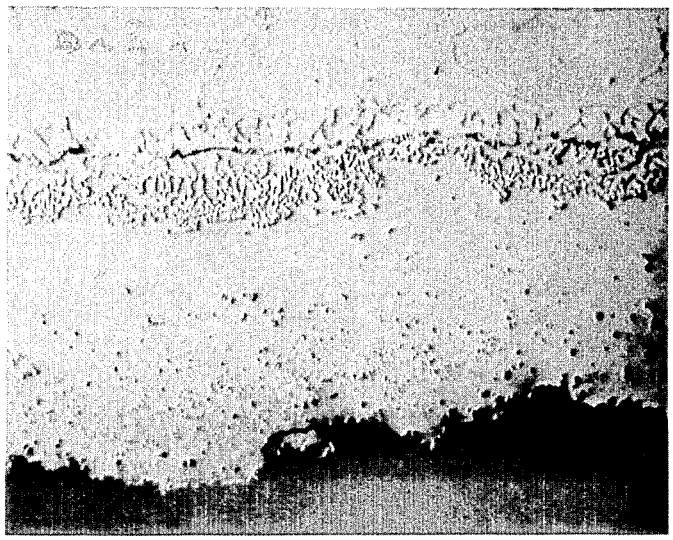
FIG. 1 is a reproduction of a photomicrograph magnified 500 times illustrating a duplex coating produced in accordance with this invention after heat treatment. The first and second layers originally deposited are evident.

This invention involves a process for producing coatings on metallic articles for the purpose of rendering the articles resistant to corrosion and oxidation at elevated temperature. The articles with which the present invention is concerned comprise iron base, nickel base and cobalt base superalloys; dispersion strengthened alloys; composites; and directional eutectics.

According to the invention, a ductile and corrosion resistant metallic alloy is initially deposited as an inner layer on the substrate. Thereafter, an outer layer of another metallic alloy is applied over the inner layer. The metallic alloy of the outer layer is particularly characterized by a composition which has greater resistance to oxidation and corrosion but lower ductility at elevated temperatures than that provided by the metallic alloy of the inner layer.

The application of both layers is preferably achieved by plasma spraying, although other means such as physical vapor deposition, ion plating, sputtering or slurry sintering may be employed. In plasma spraying, the heated alloy particles are impinged on the preheated surface of the metal article at very high velocity and temperature. Such particles, upon contact with the metal article surface or with other applied particles, deform plastically and fuse and bond to the surface or to the other applied particles thus producing a dense and adherent coating. Plasma spraying is particularly desirable since it is a generally less costly technique for accomplishing the overlay coating and since the technique is applicable to all contemplated coating compositions.

The ductile inner metallic alloy, which is applied directly to the article surface, preferably comprises an alloy having as a base element a transition metal comprising cobalt, iron or nickel or a combination of these elements. Amounts of chromium, aluminum, yttrium or other reactive elements such as hafnium and zirconium are alloyed with the base metal pursuant to the preferred practice of the invention.

The chemistry of the inner layer is contemplated such that the superior oxidation and corrosion resistance of the subsequently applied outer layer is not seriously degraded. Further, the inner layer acts as a barrier to interdiffusion of various elements between the outer layer and the substrate, the outer layer thus having a tendency to be less embrittled by the substrate elements which might have diffused otherwise. There is also a lessened tendency toward embrittlement because the outer layer is supported by a relatively ductile inner layer, and not by a brittle, multiphase layer that is conventionally the case.

The inner layer is applied in amounts between 0.0005 and 0.005 inches. The chemical composition of the inner layer is envisioned such that it is chemically and mechanically compatible with the substrate on one side and with the outer layer on the other side. This minimizes the occurrence of thermal fatigue cracks due to strain mismatch at the substrate and coating interface and/or at the inner layer to outer layer interface. Thus, the coating of the invention is particularly resistant to spalling.

Widespread oxidation and corrosion of the inner layer is avoided because the composition of the inner layer is such that it is oxidation and corrosion resistant and further, it is protected by the outer layer which is contemplated to be highly oxidation and corrosion resistant. As noted, the composition of the inner layer preferably comprises a cobalt, iron or nickel base alloy with aluminum, chromium and yttrium or other rare earth element additions. The optimum composition for a specific application will depend somewhat on the outer layer composition and substrate involved. However, aluminum contents intermediate those of the substrate and outer layer are desired in order to promote chemical stability at high temperature while providing adequate ductility and corrosion resistance.

The outer layer is applied in amounts between one-half to four times the thickness of the inner layer. The chemistry of the outer layer is such that it is more oxidation and corrosion resistant than the inner layer, albeit less ductile. The preferred composition comprises a cobalt, iron or nickel base material with appropriate aluminum and chromium additions. Additionally, it is contemplated that: (1) up to 10 weight percent of reactive elements selected from the group consisting of yttrium, cerium, scandium, thorium, hafnium, zirconium, titanium and tantalum may additionally be alloyed with the aforementioned material for improved oxidation resistance, the respective amounts of individual elements preferably varying from about 0.05 up to 5.0 percent by weight; (2) The total amount of aluminum and other oxidation/corrosion resistant elements in the outer layer should be at least 18 weight percent more than the amounts of these elements in the inner layer thus providing the duplex coating with a larger reservoir of protective elements.

If utilized alone on the superalloy substrate, a coating with the composition of the outer layer described above will not consistently exhibit long-time oxidation, hot corrosion and thermal fatigue resistance. Thus, the outer layer contains a large amount of a less ductile phase (aluminides of nickel and/or cobalt) which tend to crack under high mechanical and thermal stresses. Once a crack develops, an oxidizing or other hot corrosive atmosphere can gain access to the underlying substrate thereby causing a premature coating failure. As indicated, the presence of a ductile inner layer coating inhibits the formation of and arrests the propagation of such cracks and avoids such problems. Thus, the advantages of having a highly oxidation and corrosion resistant material as an outer layer in the duplex coating can be exploited. In addition, coatings with relatively thick outer layers can be used.

Optionally, the addition of up to 5 weight percent of rare earth and/or refractory metal oxide particles to the aforementioned outer layer composition of the duplex coating also is contemplated; these ingredients preferably being individually utilized in amounts from about 0.05 up to about 1.0 percent by weight. The ingredients are preferably selected from the group consisting of yttrium, scandium, cerium, hafnium, zirconium, titanium, tantalum, aluminum and spinels thereof. This addition can be beneficial to the over-all protective response of the coating because the reactive metal oxide particles assist in pinning protective oxide scales. This pinning phenomenon results in superior adherence (less spalling) of the protective scale thus increasing the over-all coating life.

The utilization of the plasma spray technique to deposit the contemplated two-layer duplex coating is preferred. The technique is economical, and it enables application of the duplex coating in one uninterrupted operation. Thus, the plasma spray technique involves the utilization of powder of a desired composition, this powder being fed into a plasma gun prior to its application to a substrate. The plasma spray mechanisms permit the changing of the composition during the course of the spraying operation whereby the process can involve the application of a first layer and the uninterrupted commencement of the application of the second layer to promote consistent metallurgical bonding between the two layers.

The plasma spray process is also adaptable to the application of the layers in a gradient fashion. Specifically, the composition being fed to the spraying gun may be controlled to avoid abrupt transition between the two layers. Considering the subsequent examples, it will be noted that the first layer includes low percentages of aluminum while the second layer includes higher percentages of this element. The utilization of powder compositions fed to the spraying gun which include an increasing ratio of the high aluminum content (outer) coating is, therefore, contemplated. This arrangement, when utilized at an intermediate phase of the coating operation particularly tends to eliminate distinct areas of demarcation between the coatings which makes the coatings more suitable for withstanding physical and thermal stresses.

The plasma spray process also permits deposition of a wide variety of coating materials encompassing broad ranges of nickel, cobalt, aluminum, chromium, and various rare earth and refractory metal elements. Accordingly, different coating compositions can be tailored for protection in different environments where this process is used. Further, the process also allows efficient itroduction of oxide particles into the coating which would be difficult or impossible to incorporate if other processing methods were used.

The following are examples of the practice of the invention:

EXAMPLE 1

A typical nickel base superalloy of the type used in gas turbine engines, known as IN738, and having a nominal composition of 0.09% C, 16.0% Cr, 8.5% Co, 1.7% Mo, 2.5% W, 1.7% Ta, 3.5% Ti, 3.5% Al, 0.01% B, 0.03% Zr and the balance Ni, was provided for coating.

The nominal composition of the metallic powder which was used to deposit the inner layer of the duplex coating was, by weight percent, 6% Al, 26% Cr, 0.6% Y, 31% Ni and the balance Co. The outer layer powder composition was, by weight percent, 26% Al, 16% Cr, 0.6% Y, 17% Ni and the balance Co. The application of both layers was accomplished by utilizing the plasma spray coating technique. Both alloy powders were sprayed in a plasma arc (>Mach 3 velocity) using argon and helium as primary and secondary gases, respectively. Spraying was performed in a chamber maintained at a pressure of 60 torr. The process parameters were:

| | |
|---|---|
| Gun to workpiece distance | 13 in. |
| Primary gas (argon) | 600CFH at 250 psi |
| Secondary gas (helium) | 150CFH at 250 psi |
| Voltage | 85 volts |
| Current | 800 amp |
| Powder flow | 0.3 lb/min |
| Carrier gas (argon) | 50CFH at 250 psi |
| Time for inner layer deposition | 20 sec. |
| Time for outer layer deposition | 70 sec. |

The articles were then subjected to heat treatment in a vacuum for four hours at 1975° F.

A 500× photomicrograph of this duplex coating in the unetched condition is shown in FIG. 1. As controlled during the spray operation, the thickness of the inner layer was observed to be between 0.001 inches to 0.0015 inches and the thickness distribution of the outer layer ranged between 0.003 inches to 0.004 inches. The outer layer is essentially a single phase (Co, Ni) Al compound containing up to 20 weight percent Cr and 0.6% Y. This phase is very resistant to oxidation and corrosion and, therefore, was processed about three (3) times as thick as the inner layer to provide the coating with a large reservoir of corrosion resistant material. The inner layer is an intimate mixture of (Co, Ni) Al phase and (Co, Ni) solid solution phase. This layer is less corrosion resistant than the outer layer but is superior in ductility and, therefore, supports the outer layer during thermal fatigue and mechanical stress application.

The performance of the articles coated pursuant to this example was evaluated by using a 0.7 Mach burner rig testing. The testing cycle was 1750° F./2 minutes; 1450° F./4 minutes; 1750° F./2 minutes; air cool/2 minutes. 5 ppm salt solution was injected into the combustion products of JP5 fuel containing 0.2% surphur. The testing closely simulates the gas turbine engine environment, highlights the hot corrosion phenomenon, and imposes significant thermal stresses on the protection system.

Figure 2:
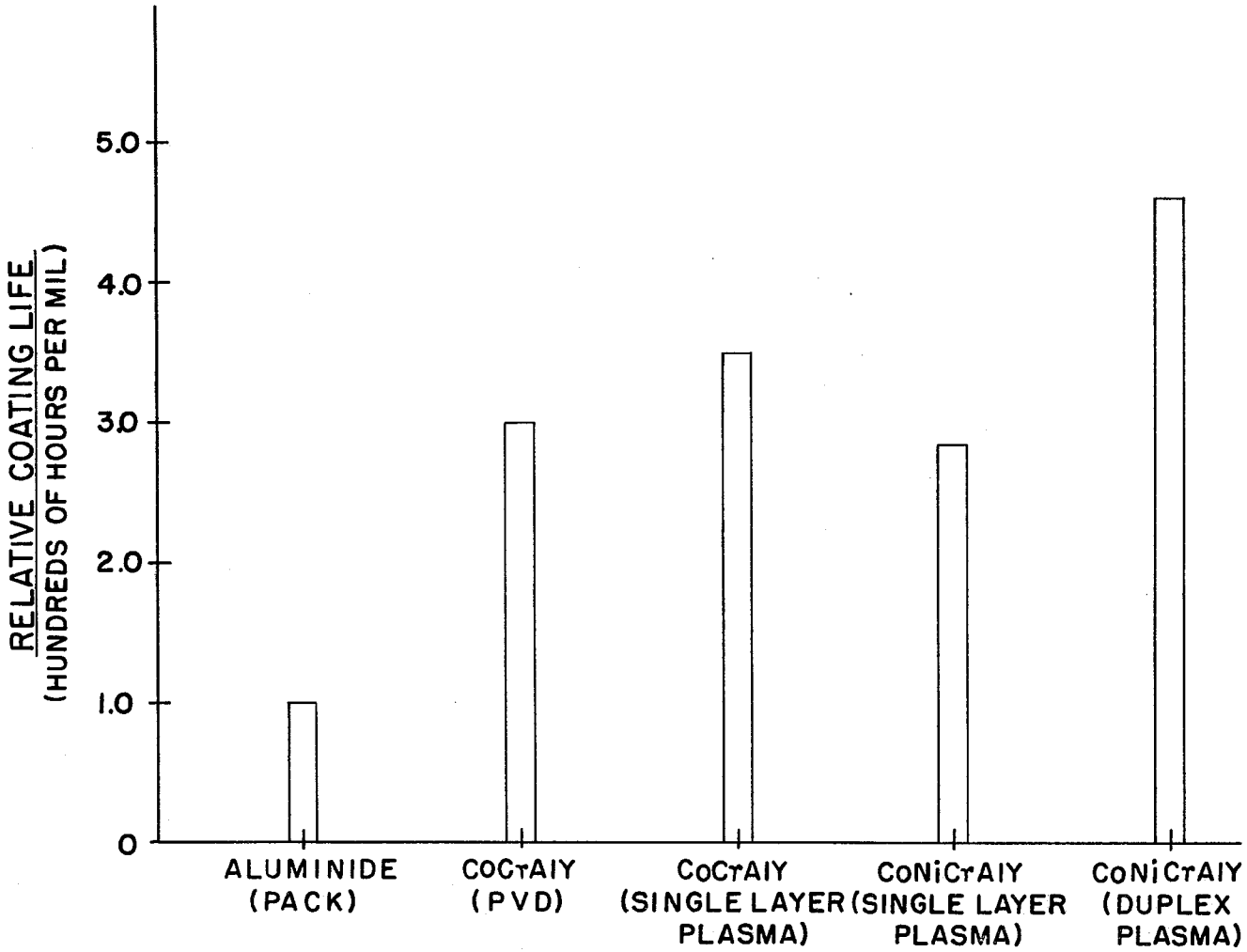
FIG. 2 is a chart comparing the various coatings in terms of hot corrosion durability of 1750° F. peak temperature.

The articles demonstrated a burner rig life of greater than 460 hours/mil of coating thickness. This compares to the 285 to 350 hours/mil lives exhibited by the single layer overlay coatings and 100 hours/mil lives exhibited by aluminide coatings as shown in FIG. 2.

EXAMPLE 2

Articles of above identified IN738 alloy were plasma sprayed with an inner layer having a chemical composition of, by weight percent, 7% Al, 30% Cr, 0.4% Y, 26% Ni and the balance Co, and an outer layer having a chemical composition of, by weight percent, 25% Al, 25% Cr, 0.7% Y, 13% Ni and the balance Co. The thickness of the inner layer was controlled to between 0.002" to 0.003", that of the outer layer was controlled to between 0.0025" and 0.0035", and an abrupt transition between the two layers was avoided. The outer layer comprised an intimate mixture of (Co, Ni) Al and (Co, Ni) solid solution phases rather than being a single (Co, Ni) Al phase, and this duplex coating was slightly more ductile than the one described in Example 1. Such a coating is more suitable for use in environments where the demand for thermal fatigue resistance is particularly severe.

It will be understood that various changes and modifications may be made in the above description which provide the characteristics of this invention without departing from the spirit thereof particularly as defined in the following claims.

That which is claimed is:

1. A method for improving the elevated temperature properties of articles comprising nickel, cobalt and iron base articles comprising the steps of applying a first coating to said articles, said first coating consisting essentially of from 15 to 30 percent by weight chromium, 3 to 7 percent by weight aluminum, up to 5 percent by weight of an element selected from the group consisting of yttrium and the rare earth elements, the balance comprising at least one member selected from the group consisting of nickel, cobalt and iron, said first coating having a nominal thickness between 0.0005 and 0.005 inches, applying a second coating over said first coating, said second coating having a thickness between one-half and four times the thickness of the first coating, said second coating consisting essentially of from 10 to 30 percent by weight chromium, 25 to 35 percent by weight aluminum, up to about 10 percent by weight of one or more elements selected from the group consisting of yttrium, scandium, cerium, hafnium, zirconium, titanium and tantalum, the balance comprising at least one member selected from the group consisting of iron, nickel and cobalt, and heat treating said article at a temperature in the range of 1900° to 2200° F. for one to 10 hours in an inert atmosphere.

2. A method in accordance with claim 1 wherein said coatings are plasma sprayed onto said articles.

3. A method in accordance with claim 2 wherein the thickness of said second coating is at least about twice the thickness of said first coating.

4. A method in accordance with claim 1 wherein said second coating includes up to 5 percent by weight of refractory metal oxide particles selected from the group consisting of oxides of yttrium, scandium, cerium, hafnium, zirconium, titanium, tantalum, aluminum and spinels thereof.

5. A method for improving the elevated temperature properties of articles comprising nickel, cobalt and iron base articles comprising the steps of applying a coating to said articles, said coating comprising an inner portion adjacent the outer article surface which consists essentially of from 15 to 30 percent by weight chromium, 3 to 7 percent by weight aluminum, up to 5 percent by weight of an element selected from the group consisting of yttrium and the rare earth elements, the balance comprising at least one member selected from the group consisting of nickel, cobalt and iron, gradually varying the coating composition so that the coating comprises an outer portion which consists essentially of from 10 to 30 percent by weight chromium, 25 to 35 percent by weight aluminum, up to about 10 percent by weight of one or more elements selected from the group consisting of yttrium, scandium, cerium, hafnium, zirconium, titanium and tantalum, the balance comprising at least one member selected from the group consisting of iron, nickel and cobalt, and heat treating said article at a temperature in the range of 1900° to 2200° F. for one to 10 hours in an inert atmosphere.

6. A method in accordance with claim 5 wherein said coatings are plasma sprayed onto said articles.

7. A method in accordance with claim 5 wherein at least the outer portion of said coating includes up to 5 percent by weight of refractory metal oxide particles selected from the group consisting of oxides of yttrium, scandium, cerium, hafnium, zirconium, titanium, tantalum, aluminum and spinels thereof.

* * * * *